US006332728B1

(12) United States Patent
Ito et al.

(10) Patent No.: US 6,332,728 B1
(45) Date of Patent: Dec. 25, 2001

(54) BALL FOR BALL-POINT PEN

(75) Inventors: Tadaaki Ito; Yasunori Nakatani; Atsushi Ito; Hiroyoshi Yamamoto, all of Osaka (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/454,390

(22) Filed: Dec. 3, 1999

(30) Foreign Application Priority Data

Dec. 3, 1998 (JP) ..... 10-343505
Sep. 16, 1999 (JP) ..... 11-261523

(51) Int. Cl.[7] ..... B43K 7/10
(52) U.S. Cl. ..... 401/215
(58) Field of Search ..... 401/215, 209

(56) References Cited

U.S. PATENT DOCUMENTS 3,303,825 * 2/1967 Shuman et al. ..... 401/215
3,390,967 * 7/1968 Frehn et al. ..... 401/215
3,503,692 * 3/1970 Kubota et al. ..... 401/215
3,628,921 * 12/1971 Hill ..... 401/215
4,182,627 * 1/1980 Hardwick et al. ..... 401/215
4,653,950 * 3/1987 Yoshida ..... 401/215

* cited by examiner

*Primary Examiner*—David J. Walczak
*Assistant Examiner*—Peter deVore
(74) *Attorney, Agent, or Firm*—Wood, Phillips, VanSanten, Clark & Mortimer

(57) ABSTRACT

A ball for a ball-point pen is provided which is composed of a sintered material obtained by sintering hard particles and having an average inter-particle diameter of not greater than 0.2 $\mu$m. The gaps between the hard particles are very small and, therefore, very few minute fragments of the hard particles are exposed from binder metal portions on the surface of the ball and fall off to act as an abrasive during use of the ball-point pen. Thus, abrasion of a pen tip body and sinkage of the ball into the pen tip body can be prevented.

5 Claims, 9 Drawing Sheets

BALL FOR BALL-POINT PEN

BACKGROUND OF THE INVENTION

1. Field of the Invention

The present invention relates to balls for a ball-point pen which are to be fitted in a pen tip of the ball-point pen.

2. Description of the Related Art

A pen tip of a gel-ink ball-point pen typically has a construction as shown in FIG. 7. In FIG. 7, a pen tip body 10 has a hollow inside portion and a tapered tip portion provided at a front end thereof, and a writing ball (hereinafter referred to simply as "ball") 11 is rotatably fitted in the tip portion. An ink reservoir tube (not shown) is connected to a rear end of the ball tip body 10, so that ink is supplied to the hollow inside portion from the ink reservoir tube and then to the ball 11 through an ink flow path 12.

More specifically, the tip portion of the pen tip has a ball socket 13 communicating with the ink flow path 12, and the ball 11 is rotatably retained in the ball socket 13 by a crimped rim 14 provided at an opening of the ball socket 13 as shown in FIG. 8. The ball socket 13 has a concavely tapered innermost surface 15, on which five ink channels 16 are radially provided as shown in FIG. 9 to ensure a sufficient ink flow.

When a line is to be written on a paper surface 22 with the ball-point pen having the above pen tip, the ball 11 provided at the pen tip is pressed against the paper surface 22 with the pen tip tilted with respect to the paper surface 22 as shown in FIG. 10. At this time, the ball 11 is displaced diagonally upward (in an arrow direction B as seen in FIG. 10) within the ball socket 13. The ink is introduced into the ball socket 13 from the hollow inside portion of the pen tip body 10 through the ink flow path 12 and the ink channels 16, and flows out through a gap between a wall surface of the ball socket 13 and the ball 11 (in an arrow direction C as seen in FIG. 10) by gravity. While the ball 11 is rolled across the paper surface 22, the ink flows through the surface of the ball 11 to be laid down on the paper surface 22 for the writing.

Typically used as a material for the ball 11 is a cemented carbide. For formation of the ball 11, the cemented carbide is shaped into a spherical body, which is then polished. More specifically, a cemented carbide obtained by sintering a mixture of particles 17 of a hard intermetallic compound such as WC and a binder metal 18 such as Co is shaped into a spherical body, and a surface 19 of the spherical body is mirror-finished by polishing.

In the case of the aforesaid conventional ball 11, however, gaps between the hard intermetallic compound particles 17 are filled with the binder metal 18, so that minute fragments of the hard intermetallic compound are exposed from binder metal portions 18 on the surface 19 of the ball 11 after the ball surface 19 is mirror-finished. During use of the ball-point pen, the binder metal portions 18 are abraded, and the minute fragments 20 fall off as shown in FIG. 12. The minute fragments 20 having thus fallen off act as an abrasive thereby to abrade the pen tip body 10.

As the soft binder metal portions 18 between the hard intermetallic compound particles 17 are abraded, edges 21 of the hard intermetallic compound particles 17 are exposed on the polished ball surface. When the ball 11 having the edges 21 of the hard intermetallic compound particles 17 exposed on its surface is rotated with a writing pressure being applied thereto, the edges 21 have a cutter-like action on the pen tip body 10, so that the tapered surface 15 of the ball socket 13 of the pen tip body 10 is abraded thereby to cause the ball 11 to sink into the pen tip body 10 as shown in FIG. 13.

The abrasion of the tapered surface 15 of the pen tip body 10 causes the ink channels 16 to clog, thereby reducing the ink flow. Further, a friction resistance between the ball 11 and the pen tip body 10 is increased with a greater contact surface therebetween, so that the ball 11 cannot smoothly be rotated. Moreover, the sinkage of the ball 11 into the pen tip body 10 causes the crimped rim 14 of the pen tip body 10 to abut against the paper surface unless the pen is oriented at a greater angle with respect to the paper surface. This results in skipping or thinning of written lines. That is, the angle of the pen with respect to the paper surface 22 which ensures smooth writing (writing permissible angle) becomes greater. With a greater writing permissible angle, the displacement of the ball 11 in the writing (movement of the ball 11 in the arrow direction B as seen in FIG. 10) is reduced, whereby the gap between the wall surface of the ball socket 13 and the ball 11 through which the ink flows out is narrowed to further reduce the ink flow. With the conventional ball 11, therefore, the pen tip body is abraded at an early stage of use of the ball-point pen, so that writing irregularities such as skipping or thinning of written lines and deterioration of writing feeling occur earlier.

In view of the foregoing, it is an object of the present invention to provide a ball for a ball-point pen which can alleviate the abrasion of the pen tip body to ensure a satisfactory writing feeling for an extended period.

SUMMARY OF THE INVENTION

In accordance with a first aspect of the present invention to attain the aforesaid object, there is provided a ball for a ball-point pen, which is composed of a sintered material obtained by sintering hard particles, and having an average inter-particle distance of not greater than 0.2 $\mu$m.

In accordance with a second aspect of the present invention, there is provided a ball for a ball-point pen, which is composed of a sintered material obtained by sintering a mixture of hard particles and a binder metal, and having a Vickers hardness of not lower than Hv 1800.

In accordance with a third aspect of the present invention, there is provided a ball for a ball-point pen, which is composed of a sintered material obtained by sintering a mixture of hard particles and a binder metal, wherein the binder metal is present in the sintered material in a proportion of not greater than 10 wt %, based on a total weight of elements in the sintered material each having an atomic weight not smaller than the atomic weight of sodium.

In the case of the ball according to the first aspect of the present invention, the average inter-particle distance is not greater than 0.2 $\mu$m, which is smaller than in the prior art. Therefore, gaps between the hard particles are very small, so that the size and number of minute fragments exposed from binder metal portions on the surface of the ball are correspondingly reduced. Therefore, the number of minute fragments which may fall off to act as an abrasive during use of the ball-point pen can be reduced, whereby the abrasion of the pen tip body and hence the sinkage of the ball into the pen tip body can be prevented.

Even though the ball is composed of the sintered material obtained by sintering the hard particles alone without a binder metal, the average inter-particle distance is small. Therefore, few particle edges which have a cutter-like action on the pen tip body are present on the ball surface, so that the abrasion of the pen tip body and hence the sinkage of the ball into the pen tip body can be prevented.

Thus, the problems associated with the prior art, i.e., the reduction in the ink flow due to the clogging of the ink channels and the increase in the friction resistance between the ball and the pen tip body due to a greater contact surface therebetween, can be prevented. Further, the increase in the writing permissible angle is suppressed. Accordingly, the deterioration of the writing feeling at an early stage of use of the ball-point pen can be prevented, so that a satisfactory writing feeling can be ensured for an extended period. Since the abrasion of the pen tip body can be suppressed, a ball-point pen with a fine point can be provided by reducing the diameter of the ball.

In the case of the ball according to the second aspect of the present invention, the Vickers hardness of the sintered material is not smaller than Hv 1800. In the case of the ball according to the third aspect of the present invention, the content of the binder metal in the sintered material is not greater than 10 wt %, based on the total weight of the elements each having an atomic weight not smaller than the atomic weight of sodium. Since the content of the binder metal in the sintered material is smaller and the hardness of the sintered material is higher than in the prior art, binder metal portions present between the hard particles are very thin, and the size and number of minute fragments of the hard particles exposed from the binder metal portions on the surface of the ball are remarkably reduced. Therefore, the number of minute fragments which may fall off to act as an abrasive is remarkably reduced, whereby the abrasion of the pen tip body and hence the sinkage of the ball into the pen tip body can be prevented. Thus, the problems associated with the prior art, i.e., the reduction in the ink flow due to the clogging of the ink channels and the increase in the friction resistance between the ball and the pen tip body due to a greater contact surface therebetween, can be prevented. Further, the increase in the writing permissible angle is suppressed. Accordingly, the deterioration of the writing feeling at an early stage of use of the ball-point pen can be prevented, so that a satisfactory writing feeling can be ensured for an extended period. Since the abrasion of the pen tip body can be suppressed, a ball-point pen with a fine point can be provided by reducing the diameter of the ball.

Where ceramic particles are employed as the hard particles for the ball of the present invention, inter-particle distances between the ceramic particles in the sintered material are smaller, so that fewer particle edges which have a cutter-like action on the pen tip body are present on the ball surface. Therefore, the abrasion of the pen tip body and hence the sinkage of the ball into the pen tip body can be prevented.

Where portions of the binder metal exposed between the hard particles on the surface of the ball of the present invention are removed so that concavities are formed on the ball surface, the minute fragments present between the hard particles on the ball surface are also removed. Therefore, the abrasive action of the minute fragments of the hard particles is eliminated, so that the abrasion of the pen tip body can further be suppressed. In addition, the ball is rotated with the ink retained in the concavities on the ball surface, whereby the ink flow can be promoted for further improvement of the writing feeling.

Where edges of the hard particles exposed around the concavities on the surface of the ball of the present invention are eliminated, the abrasion of the pen tip body can be prevented which may be caused by the particle edges in the case of the conventional ball, so that a satisfactory writing feeling can be ensured for a further extended period.

Where the ball of the present invention is used with a high viscosity ink or an ink containing an inorganic pigment for the ball-point pen, the ball can effectively ensure a satisfactory writing feeling by prevention of the abrasion of the pen tip body. More specifically, the inorganic pigment, e.g., titanium white, has a high hardness, so that the ink containing such a hard pigment heavily abrades the binder metal portions of the ball if used with the conventional ball for the ball-point pen. Therefore, the abrasive action is enhanced due to the fall-off of the minute fragments of the hard particles, thereby heavily abrading the pen tip portion. On the other hand, high viscosity inks, in which an inorganic pigment having a relatively high specific gravity can be dispersed, are now widely used for the ball-point pen. Even if such a high viscosity ink containing the hard inorganic pigment is used for the ball-point pen, the abrasion of the pen tip body by the minute fragments of the hard particles can drastically be alleviated, because the binder metal portions present between the hard particles are very thin and the size and number of the minute fragments of the hard particles exposed from the binder metal portions on the ball surface are small.

DETAILED DESCRIPTION OF THE INVENTION

The present invention will hereinafter be described in detail by way of embodiments thereof.

Figure 1:
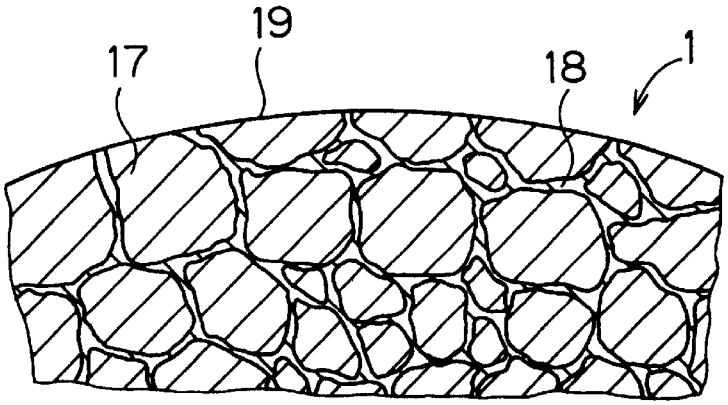
FIG. 1 is an enlarged sectional view illustrating a major portion of a ball for a ball-point pen according to a first embodiment of the present invention.
Figure 11:
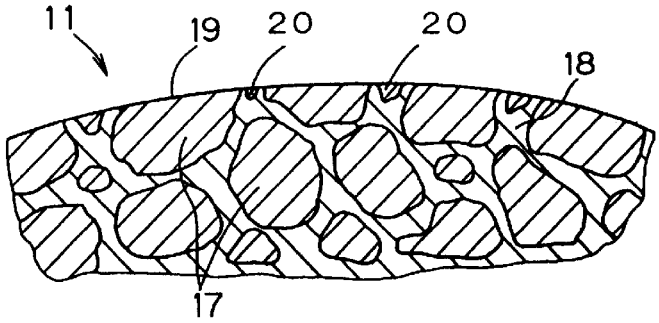
FIG. 11 (Prior Art)
FIG. 11 is an enlarged sectional view illustrating a major portion of a conventional ball for the ball-point pen.
Figure 12:
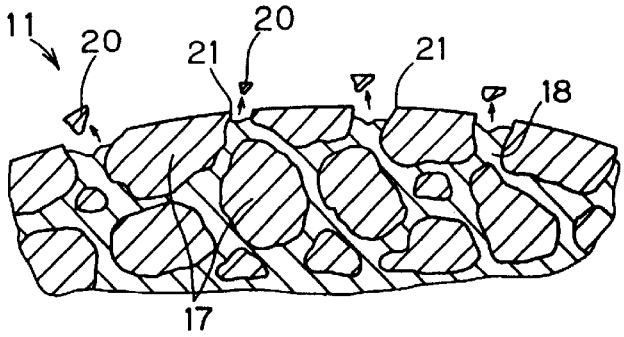
FIG. 12 (Prior Art)
FIG. 12 is an enlarged sectional view illustrating a major portion of the conventional ball in an abraded state.
Figure 13:
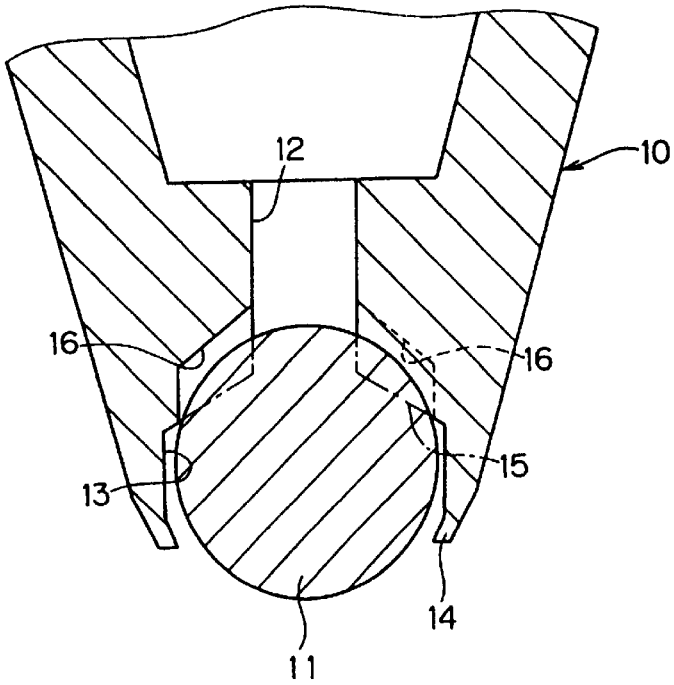
FIG. 13 (Prior Art)
FIG. 13 is an enlarged sectional view illustrating major portions of the pen tip body in an abraded state.
Figure 14:
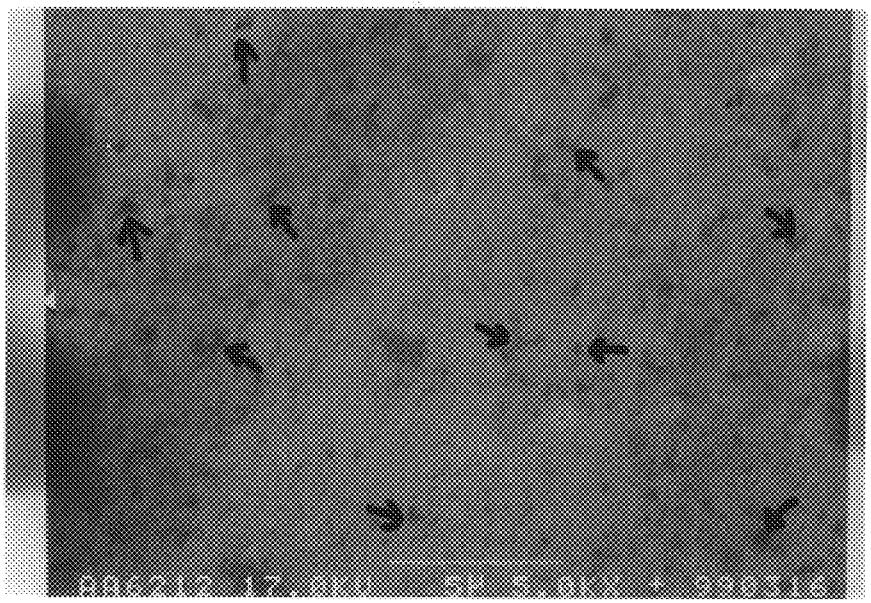
FIG. 14 is a photograph showing a surface of a ball of Example 1.
Figure 15:
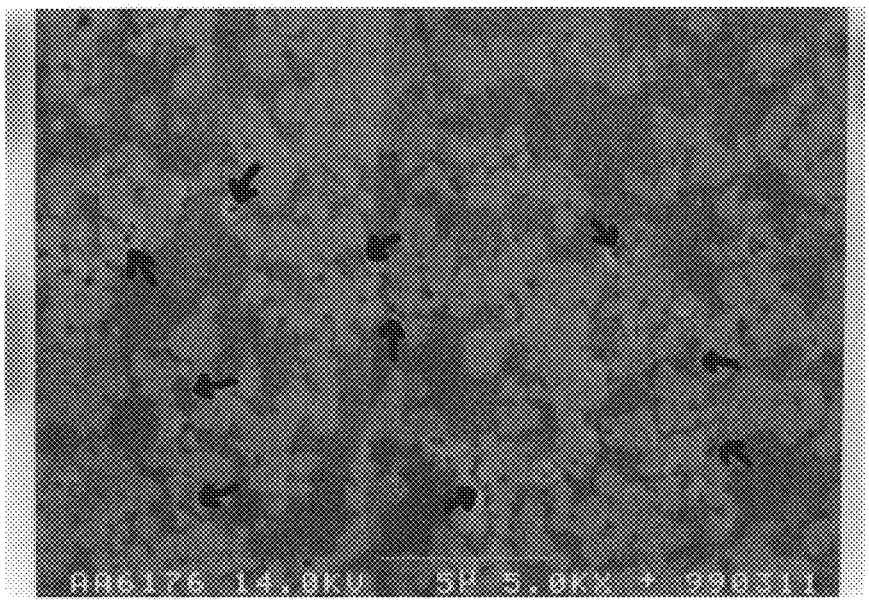
FIG. 15 is a photograph showing a surface of a ball of Example 2.
Figure 16:
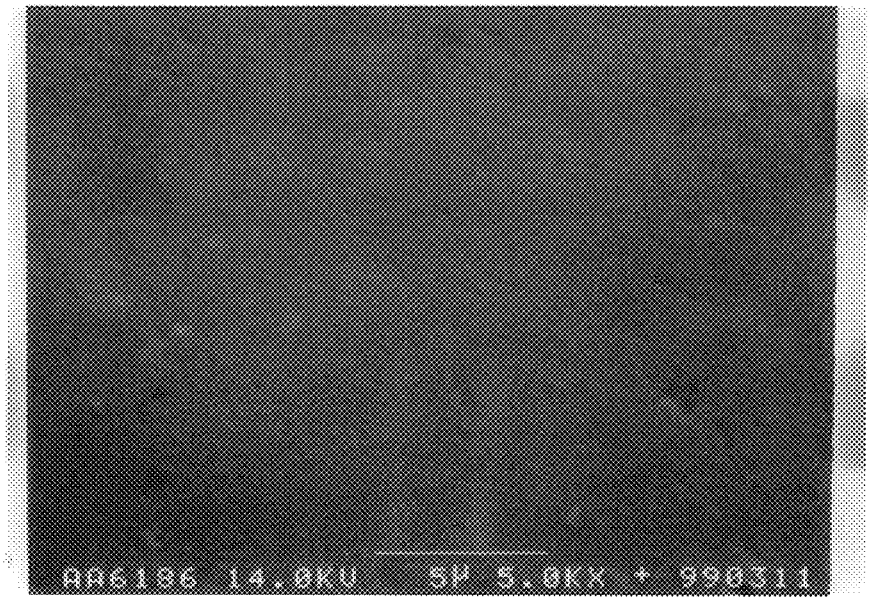
FIG. 16 is a photograph showing a surface of a ball of Example 3.
Figure 17:
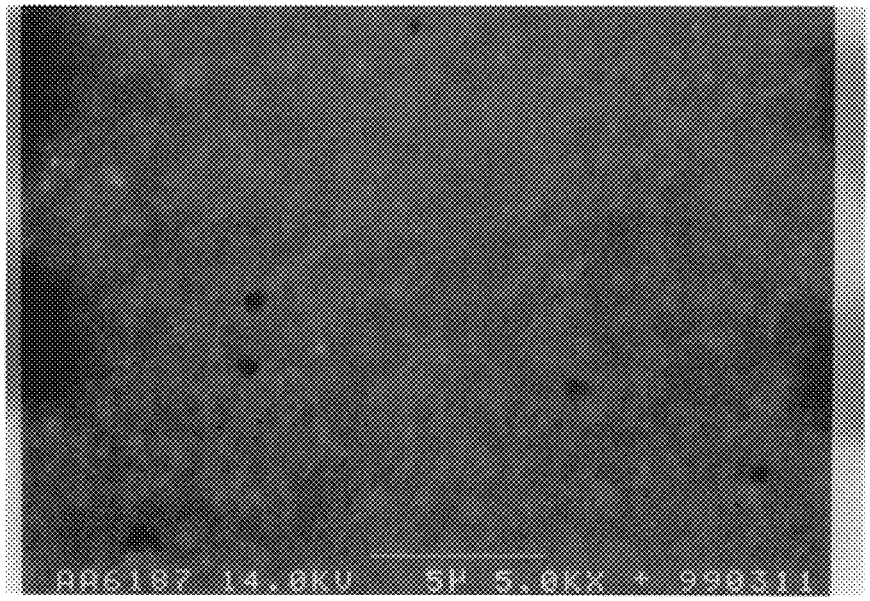
FIG. 17 is a photograph showing a surface of a ball of Example 4.

FIG. 1 shows a major portion of a ball for a ball-point pen in accordance with a first embodiment of the present invention. The ball 1 has substantially the same construction as the conventional ball shown in FIG. 11, so that like portions are denoted by like reference numerals. That is, the ball 1 is composed of a sintered material obtained by sintering a mixture of hard particles 17 such as of WC and a binder metal 18 such as Co. The sintered material is shaped into a spherical body, and the surface 19 of the spherical body is mirror-finished by polishing.

The material for the hard particles 17 is not limited to WC, but maybe selected from various compounds. Examples thereof include: carbides such as TiC, VC, $Cr_3C_2$, TaC, NbC, $Mo_2C$, $B_4C$, ZrC and SiC; oxides such as $Al_2O_3$, $CrO_3$, MgO, $SiO_2$, BeO, $ThO_2$, $TiO_2$, CaO, TiO and $ZrO_2$; nitrides such as TiN, c-BN, $Si_3N_4$ and AlN; borides such as $ZrB_2$, CrB and $TiB_2$; and silicides such as $MoSi_2$, $TiSi_2$ and $CrSi_2$. These may be used either alone or in combination.

The hard particles 17 preferably have an average particle diameter of not smaller 1 $\mu$m and not greater than 10 $\mu$m and, more preferably, the upper limit of the particle diameter is not greater than 7 $\mu$m, further preferably not greater than 5 $\mu$m. If the average particle diameter is smaller than 1 $\mu$m, the hard particles are too fine to provide the intended effects of the present invention, and a cost increase may result. If the average particle diameter is greater than 10 $\mu$m, the hard particles are too coarse, resulting in a reduction in the strength of the ball.

The binder metal 18 is not limited to Co, but may be selected from various metals. Examples thereof include Cu, Sn, P, Be, Fe, Ni, Cr, W, Mo, Al, Ti, Zr and Mn. These may be used either alone or in combination.

In other words, usable as the sintered material for the ball 1 of the present invention are: cemented carbides such as WC—Co, WC—Co—CrC, WC—TiC—Co, WC—TiC—TaC (NbC) and WC—TaC (NbC)—Co; and cermets such as of carbides, oxides, nitrides, borides and silicides. Sintered ceramic materials such as sintered SiC, sintered $ZrO_2$ and sintered $Al_2O_3$ which contain no binder metal 18 may be used as the material for the ball 1 of the present invention.

Where the sintered material for the ball is selected from the cemented carbides and the cermets, the binder metal 18 is preferably present in the sintered material in a proportion of not greater than 10 wt %, more preferably not greater than 9 wt %, most preferably not greater than 5 wt %, based on the total weight of elements in the sintered material each having an atomic weight not smaller than the atomic weight of sodium. If the proportion of the binder metal is greater than 10 wt %, the binder metal 18 forms thicker layers between the hard particles 17, so that the size and number of minute fragments of the hard particles exposed on the ball surface 19 are increased. This results in aggravation of the abrasion of the pen tip body. Where the sintered material is selected from the cemented carbides and the cermets, the binder metal 18 is preferably contained in the sintered material in a proportion of at least 1 wt % to ensure a sufficient bonding strength between the hard particles 17.

The sintered material for the ball 1 of the present invention preferably have an average inter-particle distance of not greater than 0.2 $\mu$m.

If the average inter-particle distance is greater than 0.2 $\mu$m, the size of the minute fragments of the hard particles exposed from the binder metal portions 18 on the ball surface 19 is increased. Therefore, the minute fragments fall off to act as an abrasive during use of the ball-point pen, so that the abrasion of the pen tip body 10 and hence the sinkage of the ball 1 into the pen tip body 10 are aggravated. Further, a greater average inter-particle distance enhances the cutter-like action of particle edges of the ball on the pen tip body 10, whereby the abrasion of the pen tip body 10 and hence the sinkage of the ball 1 into the pen tip body 10 are aggravated.

Figure 2:
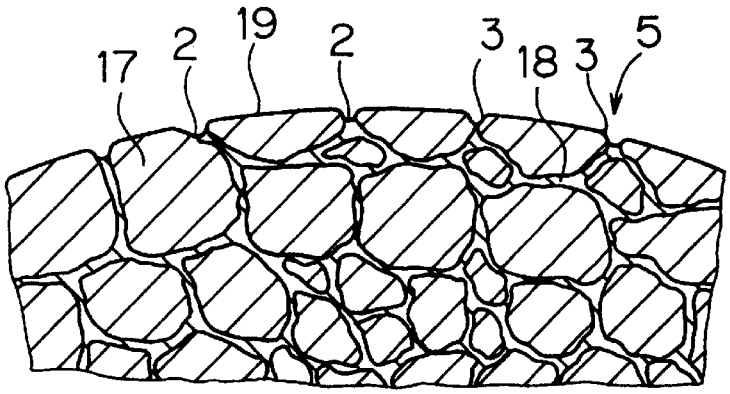
FIG. 2 is an enlarged sectional view illustrating a major portion of a ball for a ball-point pen according to a second embodiment of the present invention.
Figure 3:
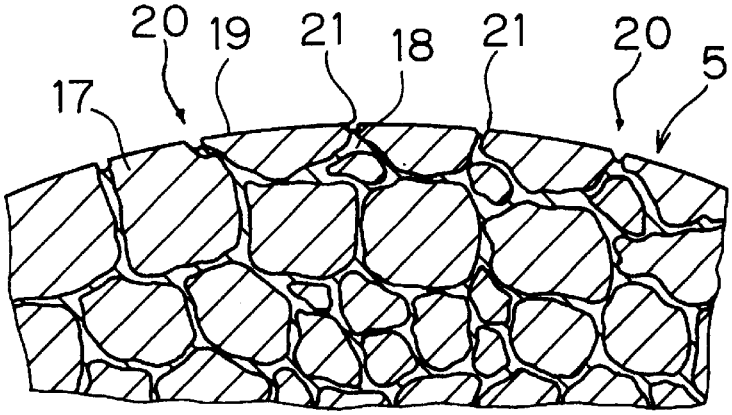
FIG. 3 is an enlarged sectional view illustrating a major portion of a ball for a ball-point pen before co-grinding of balls.

The average inter-particle distance can be determined in the following manner. The surface of the ball 11 is photographed at a magnification of about ×500 to ×5000 by means of a scanning electron microscope, and 10 to 30 inter-particle distances from the greatest are measured and then averaged. The average thus obtained is employed as the average inter-particle distance. Alternatively, the determination of the average inter-particle distance maybe achieved in the following manner. First, the ball 1 is fitted in a given pen tip body, and a writing test is performed under the following conditions: a writing angle of 65 degrees; a load of 100 g; a writing speed of 7 cm/sec; and a writing distance of 500 m. After the binder metal portions 18 on the ball surface 19 are removed to form concavities 2 on the ball surface as shown in FIG. 2, widths of the concavities 2 are measured by means of a scanning electron microscope and averaged for determination of the average inter-particle distance.

The ball 1 of the present invention preferably has a Vickers hardness of not lower than Hv 1800, more preferably not lower than Hv 1900, most preferably not lower than Hv 2000. Where the hardness is lower than Hv 1800, the binder metal 18 is present in a greater proportion in the sintered material, and forms thicker layers between the hard particles 17. Therefore, the size and number of the minute fragments of the hard particles exposed on the ball surface 19 increase, so that the abrasion of the pen tip body is aggravated. Since the hardness of the ball 1 is not greater than the hardness of the hard particles 17, the hardness of the ball 1 is Hv 2300 to Hv 2500 at the highest, which depends on the type of the hard particles 17 (intermetallic compound particles) to be used.

The ball of the present invention can be produced, for example, in the following manner. Hard particles 17 are sintered under predetermined sintering conditions, and the sintered material is shaped into a generally spherical body. The spherical body is rolled along with diamond powder, and progressively with finer diamond powder, between a pair of grinding stones held in a uniformly spaced relation. Thus, the ball surface 19 is mirror-finished (see FIG. 1).

Figure 7:
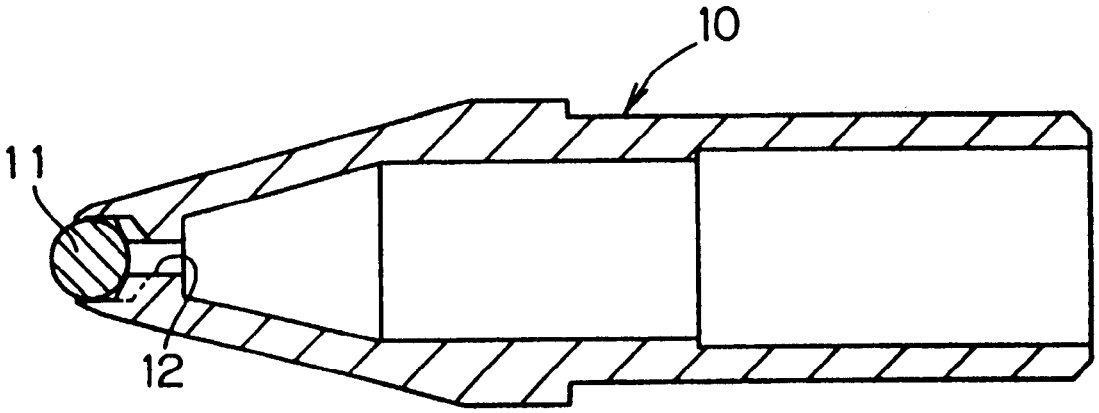
FIG. 7 (Prior Art)
FIG. 7 is a sectional view illustrating a pen tip of a ball-point pen.
Figure 8:
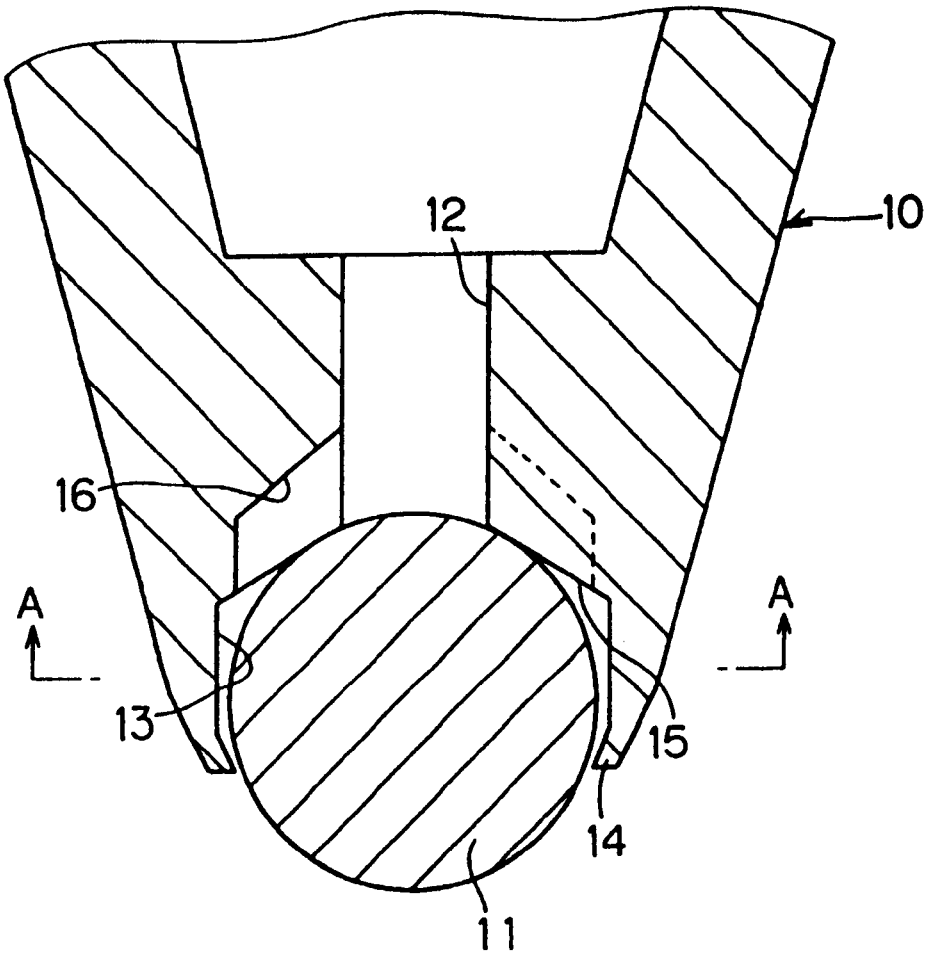
FIG. 8 (Prior Art)
FIG. 8 is an enlarged sectional view illustrating major portions of the pen tip.
Figure 9:
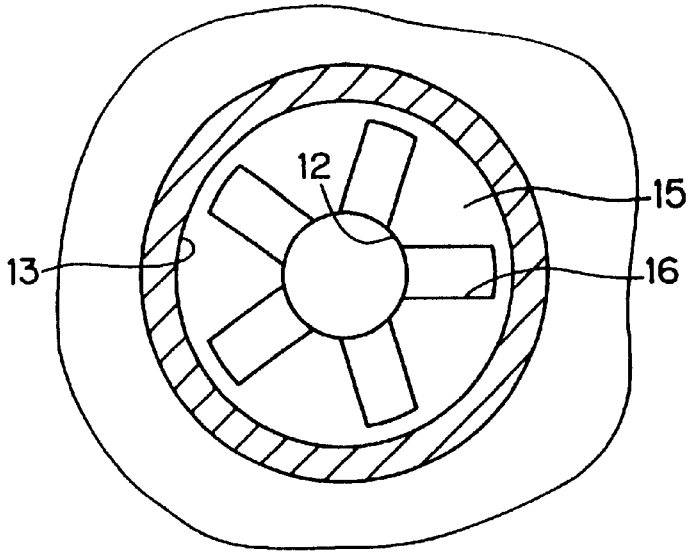
FIG. 9 (Prior Art)
FIG. 9 is a sectional view of the pen tip body taken along a line A—A in FIG. 8.
Figure 10:
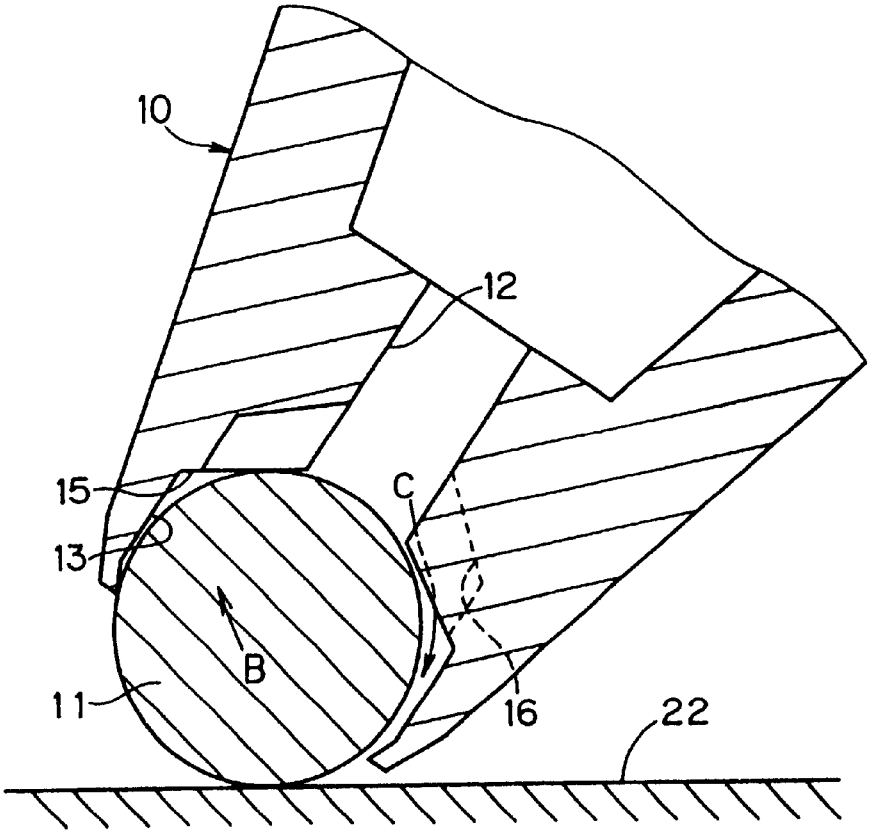
FIG. 10 (Prior Art)
FIG. 10 is a sectional view illustrating the pen tip in use.

The ball 1 is fitted in a given pen tip body, which is used for the pen tip of the ball-point pen (see FIGS. 7, 8 and 10 ).

An ink to be used with the ball-point pen is not particularly limited, but any of various inks such as oil inks, aqueous inks and gel inks may be used. Particularly, a high viscosity ink having a viscosity of not lower than 100 mPa·s and not higher than 20000 mPa·s (as measured at 0.5 rpm at 20° C. by means of an ELP viscometer with a 3° cone (R14)) is advantageously used. The lower limit of the viscosity of the ink is preferably not lower than 500 mPa·s. More specifically, even a hard inorganic pigment having a relatively high specific gravity can sufficiently be dispersed in a high viscosity ink having a viscosity in the aforesaid range. If an ink containing the hard inorganic pigment dispersed therein is used for a ball-point pen with a conventional ball, the abrasion of the binder metal portions 18 of the ball is aggravated, so that the abrasive action due to the fall-off of the minute fragments of the hard particles is enhanced to heavily abrade the pen tip body. In the case of the ball of the present invention, on the contrary, the size and number of the minute fragments of the hard particles exposed from the binder metal portions 18 on the ball surface are small. Therefore, even if the ink containing the aforesaid heavy inorganic pigment dispersed therein is used for the ball-point pen, the abrasion of the pen tip body can drastically be alleviated which may otherwise occur due to the abrasive action of the minute fragments of the hart particles.

The inorganic pigment to be used is not particularly limited, but any of various inorganic pigments may be used. Examples thereof include: oxide based pigments such as zinc white, titanium oxide, iron oxide red, chromium oxide, iron oxide black, titanium yellows (including $TiO_2.BaO.NiO$, $TiO_2.NiO.Sb_2O_3$, $TiO_2$ $.Sb_2O_3.NiO$, $ZnO.Fe_2O_3$, $ZnO.Fe_2O_3.Cr_2O_3$, $TiO_2.CoO.NiO.ZnO$ and $CoO.Al_2O_3.Cr_2O_3$), cobalt blue, cerulean blue and cobalt green; hydroxide based pigments such as alumina white, iron oxide yellow and viridian; sulfide based pigments such as cadmium yellow, cadmium red, vermilion and lithophone; chromate based pigments such as chrome yellow, molybdate orange and zinc chromate; sulfate based pigments such as gypsum and barium sulfate; carbonate based pigments such as calcium carbonate and lead white; silicate based pigments such as ultramarine blue; phosphate based pigments such as manganese violet and cobalt violet; arsenate based pigments such as emerald green; ferrocyanide based pigments such as prussian blue; metal powder based pigments such as carbon black, ocher, barium yellow, aluminum powder, bronze powder and zinc powder; and pearl based pigments such as natural pearl essence, basic lead carbonate, bismuth oxychloride and mica titanium.

Among the aforesaid inorganic pigments, titanium oxide and zinc white are particularly useful for tinting the ink with milky white. However, an ink containing titanium oxide or zinc white is liable to heavily abrade the binder metal portions 18 of the conventional ball of the ball-point pen. On the contrary, the use of the ball 1 of the present invention effectively prevents the abrasion.

When the ball 1 fitted in the pen tip is pressed against a paper surface 22 with the pen tip tilted with respect to the paper surface 22 for writing (see FIG. 10), the ball 1 is displaced diagonally upward within the ball socket 13. The ink is introduced into the ball socket 13 from the hollow inside portion of the pen tip body 10 through the ink flow path 12 and the ink channels 16, and flows out through the gap between the wall surface of the ball socket 13 and the ball 1 by gravity. While the ball 1 is rolled across the paper surface 22, the ink flows through the surface of the ball 1 to be laid down on the paper surface 22.

Since the size and number of the minute fragments of the hard particles present between the hard particles 17 on the surface of the ball 1 are small, very few minute fragments fall off to act as an abrasive during use of the ball-point pen. When the ball 1 is rotated within the ball socket 13 with a writing pressure being applied thereto, the abrasion of the pen tip body 10 can be suppressed, so that the ball 11 is prevented from sinking into the pen tip body 10. Therefore, the reduction in the ink flow due to the clogging of the ink channels 16, the increase in the friction resistance between the ball 1 and the pen tip body 10, and the increase in the writing permissible angle can be prevented, whereby a satisfactory writing feeling can be ensured.

FIG. 2 illustrates a major portion of a ball for a ball-point pen according to a second embodiment of the present invention. The ball 5 of the second embodiment has substantially the same construction as the ball of the first embodiment shown in FIG. 1, except that concavities 2 of an irregular pattern are formed on the surface of the ball by removing binder metal portions 18 between hard particles 17 such as of an intermetallic compound and some of the hard particles 17 exposed on the ball surface have round edges 3 around the concavities 2. In FIGS. 1 and 2, like portions are denoted by like reference numerals.

The ball 5 is produced, for example, in the following manner. First, hard particles 17 are sintered under predetermined sintering conditions. The sintered material is shaped into a spherical body, and the surface 19 of the spherical body is mirror-finished (see FIG. 1). Then, a plurality of such spherical bodies are co-ground in a barrel so that the soft binder metal portions 18 are abraded and minute fragments 20 of the hard particles present between the hard particles 17 on the surface of the spherical body are removed for formation of concavities 2 of an irregular pattern. The co-grinding is continuously performed to remove sharp edges 21 of the hard particles 17 around the concavities 2 on the surface of the spherical body for formation of round edges 3 (see FIG. 2).

Since the binder metal portions 18 between the hard particles 17 on the surface 19 of the ball 5 and the minute fragments 20 of the hard particles in the binder metal portions 18 have been removed, the abrasion of the pen tip can be suppressed which may otherwise occur due to the abrasive action of the minute fragments 20. Further, the ball 5 is rotated in the ball socket with the ink retained in the concavities 2 on the surface thereof, so that the ink flow is promoted by an ink feed-out effect offered by the concavities 2 of the irregular pattern to improve the writing feeling. In addition, the abrasion of the pen tip body is prevented which may otherwise be caused by the edges 21 of the hard particles exposed on the surface of the ball 5, whereby a satisfactory writing feeling can be ensured for a further extended period.

In the first embodiment, the mirror surface finish of the ball 1 is achieved by the grinding stone polishing method, but not limited thereto. Any of various polishing methods such as a magnetic fluid polishing method, an electrolytic polishing method and a chemical polishing method may be employed. Further, the balls 1, 5 each have a spherical shape in the aforesaid embodiments, but the shape of the ball is not limited thereto. The ball may have a cylindrical shape.

EXAMPLES

In Examples 1 to 4 and Comparative Examples 1 and 2, sintered materials each containing WC, SiC or $ZrO_2$ as the hard particles and Cr, Co or the like as the binder metal were used. The sintered materials were each shaped into a spherical body, which was mirror-finished to provide a 5-mm diameter ball for a ball-point pen. The compositions of the balls of Examples 1 to 4 and Comparative Examples 1 and 2 are shown in Table 1.

TABLE 1

| | Examples | | | | Comparative Examples | |
|---|---|---|---|---|---|---|
| | 1 | 2 | 3 | 4 | 1 | 2 |
| Hard particles | WC | WC | SiC | $ZrO_2$ | WC | WC |
| Binder metal | Cr, Co | TiC, Ni, Mo, Cr | — | — | Cr, Co | Cr, Co |

The balls of Examples 1 to 4 and Comparative Examples 1 and 2 were each fitted in a pen tip as shown in FIG. 7, and subjected to a continuous writing test under the following conditions by means of a writing tester (MODEL TS-4C-10) available from Seiki Kogyo Co., Ltd.

[Test Conditions]

Writing angle: 65 degrees

Load: 100 g

Writing speed: 7 cm/sec

Writing distance: 500 m

Pen tip body: stainless

[Composition of Ink Used in Writing Test]

| | |
|---|---|
| Pig. Red 258: | 5 wt % |
| Styrene-acryl resin: | 1 wt % |
| Crosslinked polyacrylic acid: | 0.24 wt % |
| Xanthane gum: | 0.24 wt % |
| Glycerin: | 7 wt % |
| Ethylene glycol: | 15 wt % |
| Diethylene glycol: | 6 wt % |
| Sodium benzoate: | 0.24 wt % |
| 1,2-benzisothiazolin-3-on: | 0.4 wt % |
| Polyoxyethylene alkyl ether phosphate: | 1.5 wt % |
| Deionized water: | 65.38 wt % |

Figure 18:
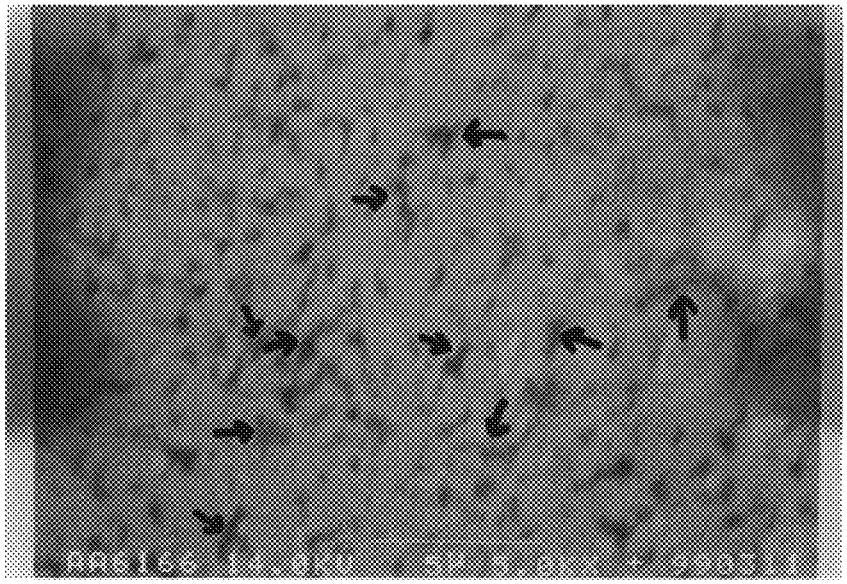
FIG. 18 is a photograph showing a surface of a ball of Comparative Example 1.
Figure 19:
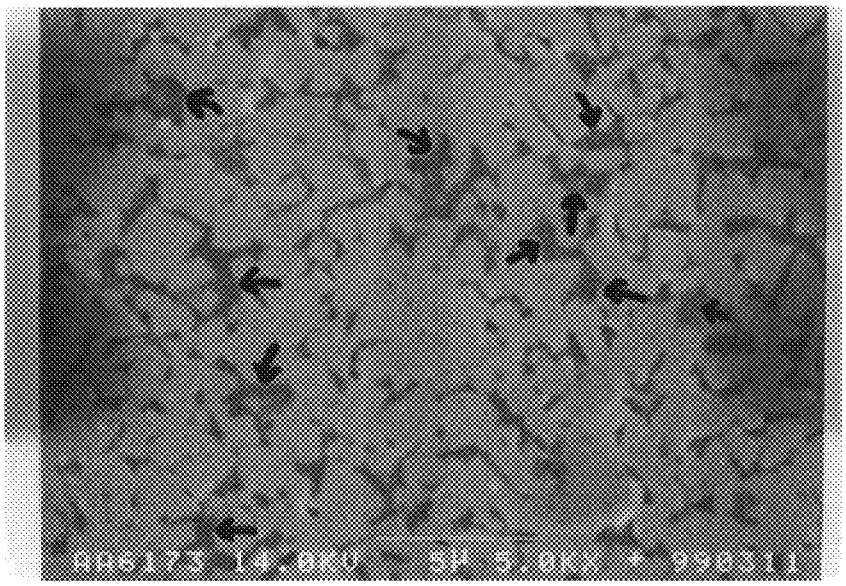
FIG. 19 is a photograph showing the surface of the ball of Comparative Example 1 after a writing test.
Figure 20:
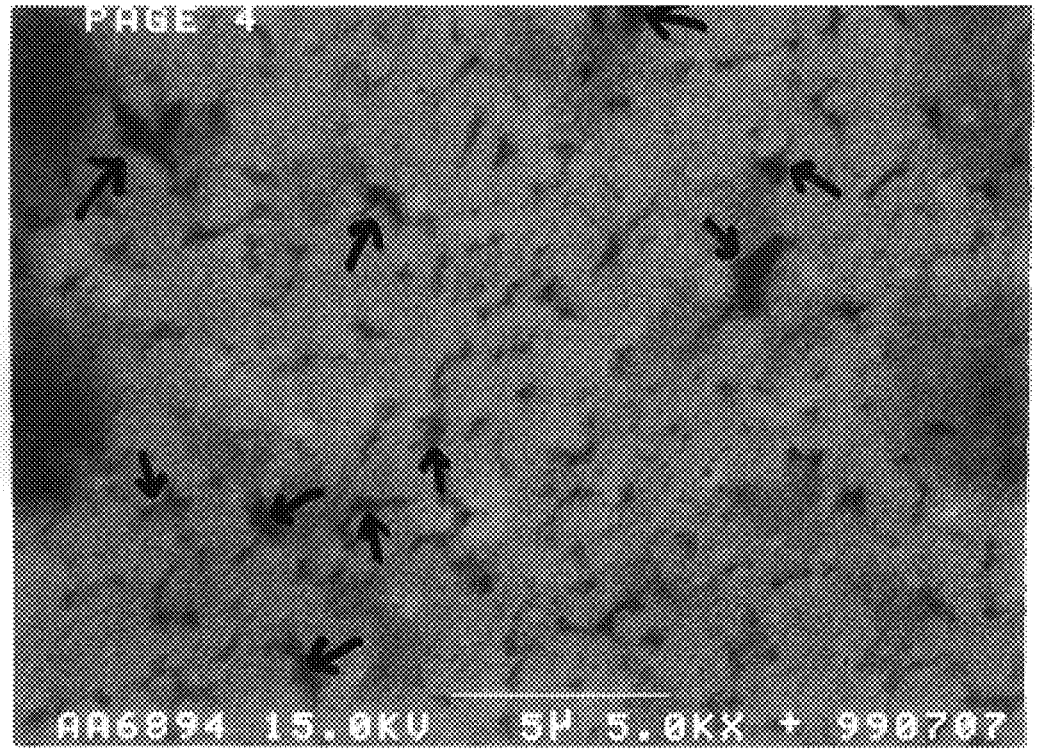
FIG. 20 is a photograph showing a surface of a ball of Comparative Example 2.

Photographs of the surfaces of the balls of Examples 1 to 4 taken before the writing test are shown in FIGS. 14 to 17. Photographs of the surface of the ball of Comparative Example 1 taken before and after the writing test are shown in FIGS. 18 and 19. A photograph of the surface of the ball of Comparative Example 2 taken before the writing test is shown in FIG. 20. These photographs were taken by means of a scanning electron microscope, and a white line provided in the bottom center of each of the photographs is a 5-$\mu$m scale. In FIGS. 14, 15, 18, 19 and 20, arrows denote measurement points (10 points) at which inter-particle distances were measured for determination of an average inter-particle distance.

For the balls of Examples 1 to 4 and Comparative Examples 1 and 2, the average inter-particle distance and the ball sinkage (abrasion wear of the pen tip body) after the writing test are shown in Table 2.

TABLE 2

| | Examples | | | | Comparative Examples | |
|---|---|---|---|---|---|---|
| | 1 | 2 | 3 | 4 | 1 | 2 |
| Inter-particle distance ($\mu$m) | 0.16 | 0.12 | 0 | 0 | 0.26 | 0.24 |
| Ball sinkage | ○ 5 $\mu$m | ○ 7 $\mu$m | ○ 18 $\mu$m | ○ 9 $\mu$m | X 42 $\mu$m | X |

○: Acceptable ball sinkage X: Unacceptable ball sinkage

As apparent from FIGS. 14 to 20 and Table 2, the balls of Examples 1 to 4 each had a smaller average inter-particle distance than the balls of Comparative Examples 1 and 2, and provided a satisfactory result on the ball sinkage.

In Examples 5 and 6 and Comparative Example 3, cemented carbides containing WC particles having an average particle diameter of not greater than 5 $\mu$m as the hard intermetallic compound particles and Co as the binder metal were used, and the cemented carbides were each shaped into a spherical body, which was mirror-finished to provide a 0.8-mm diameter ball for a ball-point pen. The compositions of the balls of Examples 5 and 6 and Comparative Example 3 are shown in Table 1.

TABLE 3

(Unit: wt %)

| | Example 5 | Example 6 | Comparative Example 3 |
|---|---|---|---|
| WC | 96.7 | 83.35 | 85 |
| TiC | — | 8.6 | — |
| Co | 2.25 | — | 12 |
| Ti | — | — | — |
| Cr | 0.25 | 2.9 | 3 |
| Ni | 0.75 | 4 | — |
| Mo | — | 1.15 | — |
| Particulate component | 96.7 | 91.95 | 85 |
| Binder metal | 3.25 | 8.05 | 15 |

The balls of Examples 5 and 6 and Comparative Example 3 were each fitted in a pen tip as shown in FIG. 7, and subjected to a continuous writing test under the following conditions by means of a writing tester (MODEL TS-4C-10) available from Seiki Kogyo Co., Ltd.

[Writing Conditions]

Writing angle: 65 degrees

Load: 100 g

Writing speed: 5 cm/sec

Writing distance: 300 m

Pen tip body: stainless

[Composition of Ink Used in Writing Test]

| | |
|---|---|
| Titanium oxide color base: | 33.00 wt % |
| MUTICLE 240D (Mitsui Toatsu): | 29.00 wt % |
| Glycerin: | 8.00 wt % |
| PHOSPHANOL PE-510: | 1.50 wt % |
| KERZAN: | 0.28 wt % |
| PROXEL XL2: | 0.40 wt % |
| Deionized water: | 27.82 wt % |

The above titanium oxide color base had the following composition.

[Composition of Titanium Oxide Color Base]

Titanium oxide (KR270 from Titan Kogyo): 65 wt %

Aqueous solution of styrene-maleic acid resin (HYROS-X ×220 from Seiko Kagaku) neutralized by 1.4 equivalents of sodium hydroxide (resin content: 30 wt %): 20 wt %

Propylene glycol: 7 wt %

Deionized water: 8 wt %

For the balls of Examples 5 and 6 and Comparative Example 3, the ball sinkage (abrasion wear of the pen tip body) after the writing test and the hardness measured with a load of 30 Kgf are shown in Table 4.

TABLE 4

| | Example 5 | Example 6 | Comparative Example 3 |
|---|---|---|---|
| Average hardness (Hv) | 2200 | 1900 | 1575 |
| Hardness MAX (Hv) | — | 1980 | 1750 |
| Hardness MIN (HV) | — | 1820 | 1400 |
| Abrasion wear ($\mu$m) | 12 | 20 | 45 |

Figure 4:
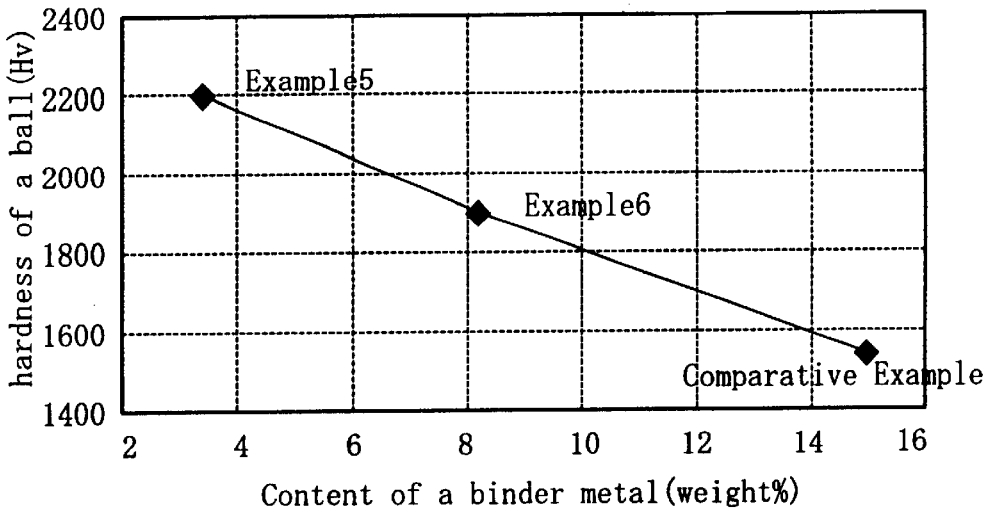
FIG. 4 is a graph showing a relationship between the hardness of a ball and the content of a binder metal.
Figure 5:
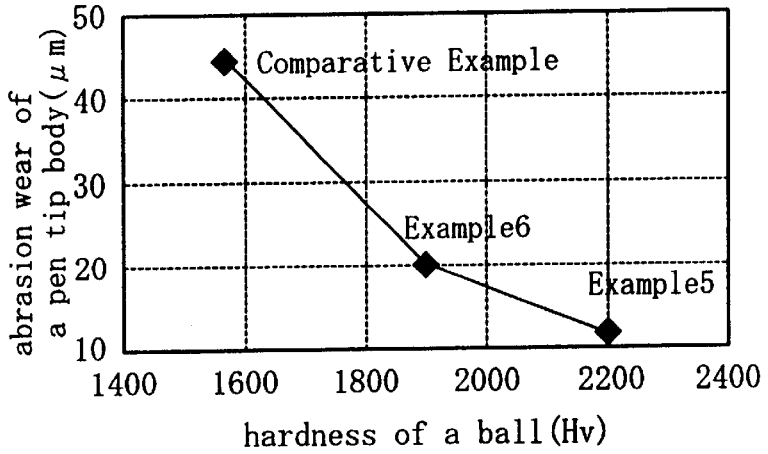
FIG. 5 is a graph showing a relationship between the hardness of a ball and the abrasion wear of a pen tip body.
Figure 6:
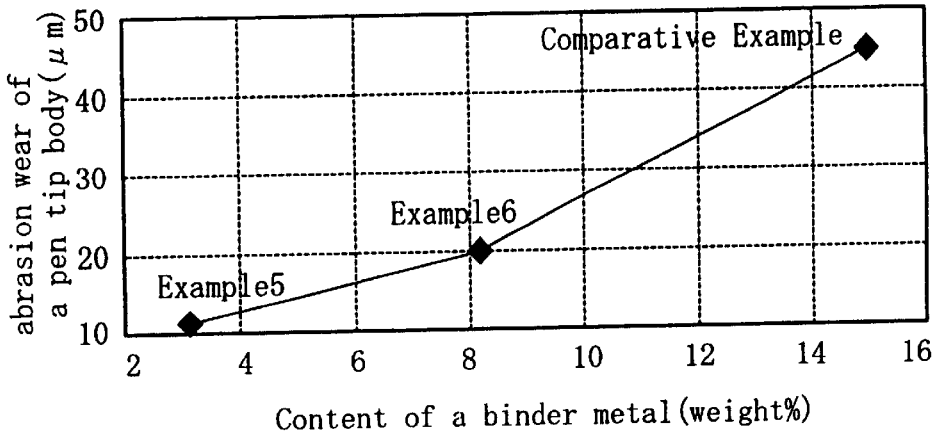
FIG. 6 is a graph showing a relationship between the content of the binder metal and the abrasion wear of the pen tip body.

A relationship between the hardness of the ball and the content of the binder metal, a relationship between the hardness of the ball and the abrasion wear of the pen tip body, and a relationship between the content of the binder metal and the abrasion wear of the pen tip body are shown in FIGS. 4, 5 and 6, respectively.

As can be seen from FIG. 4, the hardness increases with a decrease in the content of the binder metal. As apparent from FIGS. 4, 5 and 6, the abrasion of the pen tip body can significantly be suppressed by employing the balls of Examples 5 and 6 which each have a higher hardness and a lower binder metal content.

In the balls for the ball-point pen according to the present invention, as described above, the gaps between the hard particles are reduced, so that the size and number of the minute fragments of the hard particles exposed from the binder metal potions on the ball surface are reduced. Therefore, very few minute fragments fall off to act as an abrasive during use of the ball-point pen, whereby the abrasion of the pen tip body and the sinkage of the ball into the pen tip body can be prevented.

Even where the ball is composed of the sintered material obtained by sintering the hard particles alone without the binder metal, the inter-particle distances are small. Therefore, the cutter-like action of the particle edges to be exerted on the pen tip body can be suppressed, whereby the abrasion of the pen tip body and the sinkage of the ball into the pen tip body can be prevented.

Thus, the problems associated with the prior art, i.e., the reduction in the ink flow due to the clogging of the ink channels and the increase in the friction resistance between the ball and the pen tip body due to a greater contact surface therebetween, can be prevented. Further, the increase in the writing permissible angle is suppressed. Accordingly, the deterioration of the writing feeling at an early state of use of the ball-point pen can be prevented, so that a satisfactory writing feeling can be ensured for an extended period. Since the abrasion of the pen tip body can be suppressed, a ball-point pen with a fine point can be provided by reducing the diameter of the ball.

What is claimed is:

1. A ball for a ball-point pen, said ball having a spherical outer surface and comprising a sintered material obtained by sintering a mixture of hard particles and a binder metal, wherein an average thickness of a layer of the binder metal between hard particles, that is an average Inter-particle distance, is not greater than 0.2 $\mu$m, wherein concavities are formed on the spherical outer surface by removing portions of the binder metal between hard particles exposed on the spherical outer surface, such that by forming the concavities, sharp edges of the hard particles exposed at the concavities are rounded.

2. The ball according to claim 1, wherein the hard particles are ceramic particles.

3. The ball according to claim 1, which is used with a high viscosity ink for the ball-point pen.

4. The ball according to claim 1, which is used with an ink containing an inorganic pigment for the ball-point pen.

5. A ball for a ball-point pen, said ball having a spherical outer surface and comprising a sintered material obtained by sintering a mixture of hard particles and a binder metal, wherein the sintered material has a Vickers hardness of not smaller than Hv 1800, wherein the binder metal is present in the sintered material in a proportion of not greater than 5 wt % based on a total weight of elements in the sintered material each having an atomic weight not smaller than an atomic weight of sodium, wherein concavities are formed on the spherical outer surface by removing portions of the binder metal between hard particles exposed on the spherical outer surface, such that by forming the concavities, sharp edges of the hard particles exposed at the concavities are rounded.

* * * * *